US005301374A

United States Patent [19]

Smiley

[11] Patent Number: 5,301,374

[45] Date of Patent: Apr. 12, 1994

[54] URINAL ASSEMBLY

[76] Inventor: Everett J. Smiley, 1326 Sandtrap Dr. SW., Fort Myers, Fla. 33919

[21] Appl. No.: 994,354

[22] Filed: Dec. 21, 1992

Related U.S. Application Data

[63] Continuation-in-part of Ser. No. 612,920, Nov. 13, 1990, abandoned.

[51] Int. Cl.[5] ..... F03D 9/00

[52] U.S. Cl. ..... 4/341

[58] Field of Search ..... 4/301, 309, 311, 340, 4/341, 342

[56] References Cited

U.S. PATENT DOCUMENTS 4,180,875 1/1980 Wilson ..... 4/309

4,197,598 4/1980 Lemmon ..... 4/341 X

*Primary Examiner*—Charles E. Phillips

*Attorney, Agent, or Firm*—William E. Noonan

[57] ABSTRACT

A urinal assembly is disclosed for use in a toilet apparatus. There is a urinal bowl for mounting within the main toilet bowl. A urinal flush line and urinal flush valve mechanism are provided for selectively introducing water under service line pressure exclusively into the urinal bowl to flush the bowl. A discharge conduit is interconnected between the urinal bowl and the main sewer line of the toilet for discharging the contents of the urinal bowl when the urinal bowl is flushed.

15 Claims, 5 Drawing Sheets

URINAL ASSEMBLY

RELATED APPLICATIONS

This application is a continuation in part of Ser. No. 612,920, filed Nov. 13, 1990 now abandoned.

FIELD OF THE INVENTION

This invention relates to a urinal assembly for use in combination with a standard toilet and, in particular, to a water saving urinal assembly that may be manufactured as part of a new toilet or retrofit to existing toilets.

BACKGROUND OF THE INVENTION

Conventional water closets waste billions of gallons of water annually. Each time a typical toilet is flushed, at least several gallons of water are used. Such an amount is clearly excessive, particularly when only liquid waste is being flushed. Yet, most known toilets consume the same volume of water during each flush cycle, regardless of the contents being flushed.

To reduce water usage, a number of toilets have been developed that employ partitioned sections for accommodating liquid and solid waste. One known toilet, U.S. Pat. No. 3,336,602, uses a separate urinal bowl that is flushed by water under a gravity pressure head in the reservoir tank of the toilet. That apparatus requires the water in the tank to remain at a typically high level in order for the urinal flush system to operate. The system will not operate if the user desires to significantly reduce the amount of water used to flush the main bowl. Additionally, this system requires a pair of separate flush handles and cannot be retrofit onto existing toilets.

To date, no water saving toilets have employed water under the incoming service line pressure to flush the urinal bowl alone.

SUMMARY OF INVENTION

It is therefore an object of this invention to provide an improved toilet apparatus that employs a precisely controlled, reduced amount of water to flush liquid waste.

It is a further object of this invention to provide a urinal assembly in combination with a toilet that permits the water level in the toilet's reservoir tank to be significantly reduced so that water is conserved when the toilet bowl is flushed.

It is a further object of this invention to provide a urinal assembly in combination with a toilet apparatus that permits the urinal bowl to be flushed either alone or with the main bowl.

It is a further object of this invention to provide a urinal assembly that may be installed permanently with a newly manufactured toilet or retrofit to an existing toilet.

This invention results from the realization that an improved water saving toilet is achieved and the water level in the main reservoir tank of the toilet may be reduced by employing a separate urinal bowl that is flushed by water under service line pressure. Because such water is used, flushing of the urinal bowl is not dependant upon the water level in the reservoir tank. As a result, the amount of water in the tank can be reduced so that water is conserved when the main bowl of the toilet is flushed.

This invention features a urinal assembly for use in combination with a toilet apparatus having a toilet bowl, a tank communicably connected to and located generally above the toilet bowl and a supply conduit for delivering water under service line pressure to the tank. In the toilet apparatus there are inlet valve means attached to the supply conduit for regulating the flow of water into the tank. Means are provided for opening the inlet valve means when the water in the tank falls below a predetermined level to introduce water into the tank and for closing the inlet valve means when the water in the tank rises above the predetermined level to stop the flow of water into the tank. The toilet apparatus further has means for selectively releasing water in the tank into the toilet bowl to flush the bowl. A sewer line is connected to the toilet bowl for discharging the contents of the bowl when the bowl is flushed. The urinal assembly of this invention comprises a urinal bowl for mounting within the toilet bowl. There are means, interconnected between the supply conduit and the urinal bowl, for selectively introducing water under service line pressure exclusively into the urinal bowl to flush the urinal bowl. A discharge conduit is interconnected between the urinal bowl and the sewer line for discharging the contents of the urinal bowl when the urinal bowl is flushed.

In a preferred embodiment, the means for introducing include means defining a primary urinal flush line, which interconnects the supply conduit and the urinal bowl, and urinal flush valve means that are normally closed to restrict water from flowing through the primary urinal flush line into the urinal bowl. Such urinal flush valve means are selectively opened to permit water under service line pressure to flow through the primary urinal flush line into the urinal bowl. The urinal flush valve means may include a valve housing, a valve element movably mounted in the valve housing and having formed therethrough channel means that are communicably alignable with the primary urinal flush line. Spring means are provided for biasing the valve element into a closed condition within the housing such that the channel is not aligned with the primary urinal flush line. Actuator means are provided for selectively urging the valve element against the spring means to align the channel with the primary urinal flush line and open the urinal flush valve means.

The means for introducing may further include means for temporarily retaining the valve element in an open condition in the valve housing. Means may be provided for releasing the means for retaining to close the urinal flush valve means after a predetermined amount of water is introduced to the urinal bowl. Such means for retaining may include a first latch element carried by the valve element and a complementary second latch element mounted within the tank for interengaging the first latch element to retain the urinal flush valve means in an open condition. Preferably, the means for releasing include a float chamber mounted in the tank and having an opening for introducing the first latch element into the float chamber. A float element is disposed in the float chamber for carrying the second latch element and duct means communicate with the primary urinal flush line for introducing water from the line into the float chamber, whereby the float element is raised to disengage the second latch element from the first latch element.

It is further preferred that a secondary urinal flush line be interconnected between the inlet valve means and the urinal bowl. This line is responsive to opening of the inlet valve means for directing water under service line pressure into the urinal bowl. A gate valve may be interconnected to the primary and secondary urinal flush lines for selectively permitting water flow through at least one of the urinal flush lines while restricting water flow through the other of the lines. More particularly, the primary and secondary urinal flush lines include respective primary and secondary inlet segments that engage the gate valve and a common outlet segment that interconnects the gate valve and the urinal bowl. The gate valve may include means defining primary and secondary passageways that communicably interconnect the outlet segment with the primary and secondary inlet segments, respectively. A valve element typically permits water under service line pressure to flow through a selected one of the passageways while restricting the flow of water through the other of the passageways.

The gate valve may be carried by the float chamber. The duct means may include means defining an inlet and a larger outlet that permit water to be introduced into the float chamber at a first rate and subsequently drained from the float chamber at a faster second rate when the latch elements are disengaged and the urinal flush valve is closed. Stop means may be formed on the inside wall of the float chamber to support the flow chamber at a predetermined level.

The primary urinal flush line and the discharge conduit may be formed integrally with the toilet bowl. Alternatively, they may be releasably attached onto the toilet bowl or its environs.

DETAILED DESCRIPTION OF PREFERRED EMBODIMENTS

Other objects, features and advantages will occur from the following description of preferred embodiments and the accompanying drawings, in which.

Figure 1:
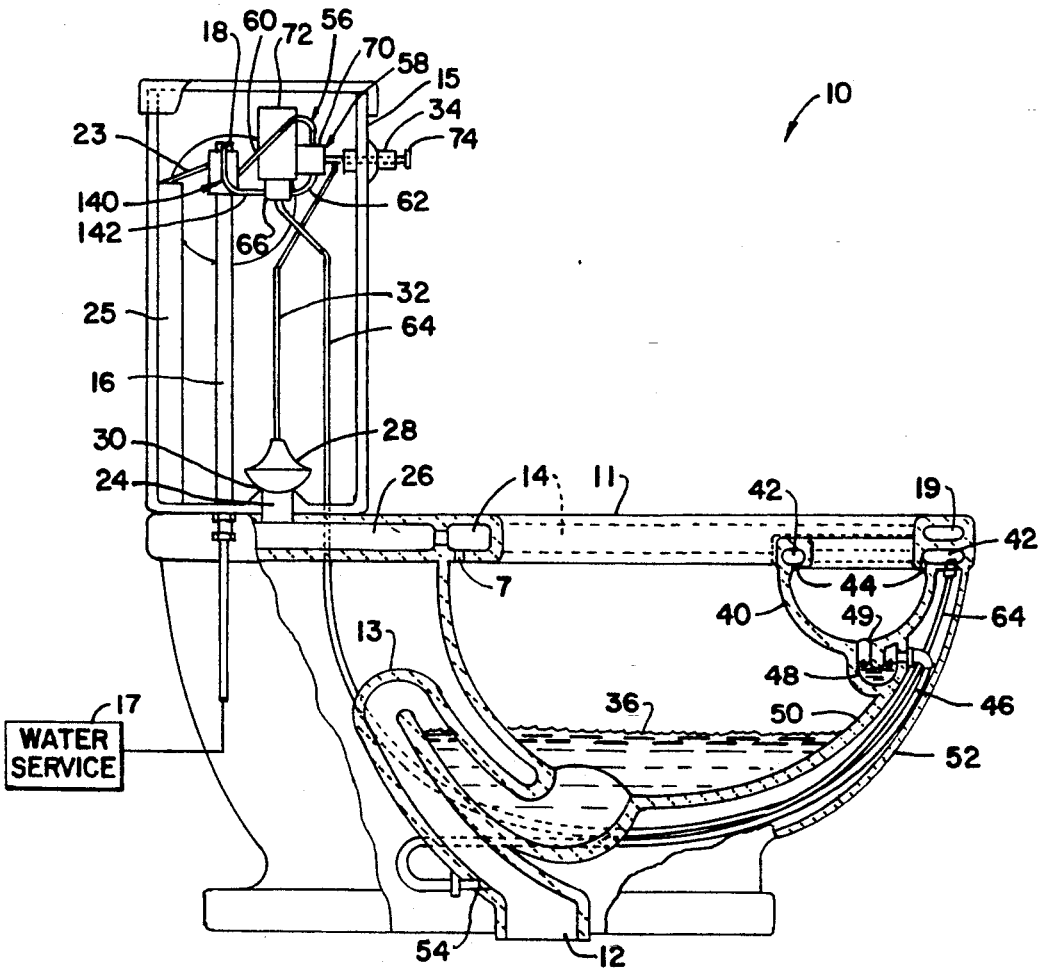
FIG. 1 is an elevational side view, partly in cross section of a toilet including the urinal assembly of this invention.
Figure 2:
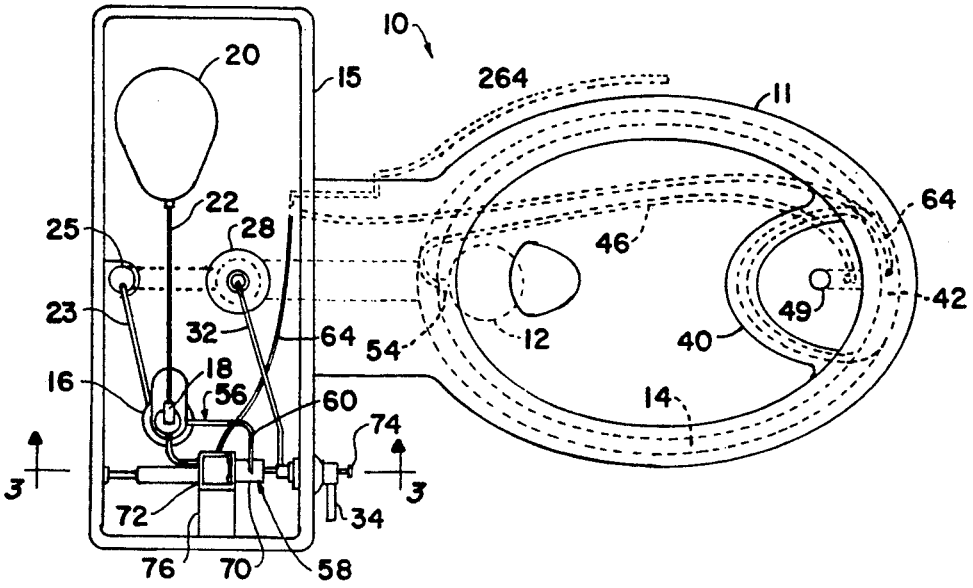
FIG. 2 is a plan view of the toilet apparatus of FIG. 1.

There is shown in FIGS. 1 and 2 a toilet apparatus 10 that employs the urinal assembly of this invention. Apparatus 10 includes a main toilet bowl 11 that is connected in a known manner to a discharge sewer line 12 through a gooseneck trap 13. A channel 14 is formed about the rim of toilet bowl 11. A forward region of channel 14 includes a relatively narrow channel segment 19, FIG. 1. Channel 14 also includes a plurality of conventional holes, not shown, that deliver water from reservoir tank 15 to the bowl 11 each time the main bowl of the toilet is flushed.

A number of conventional items are located within tank 15. In particular, a supply conduit 16 enters the bottom of the tank and extends upwardly into the tank. Supply conduit 16 is connected to the pressurized water service line 17 and provides replacement water to tank 15 each time main toilet bowl 11 is flushed. An inlet valve 18 is connected to the upper end of supply conduit 16 in a conventional manner. The inlet valve typically comprises a ballcock or other known valve for use in toilets. Inlet valve 18 is opened and closed by a float element 20 (FIG. 2) that is connected to the inlet valve by an elongate rod 22. As known in the toilet art, float 20 is buoyant. When the water in tank 15 is at or above a predetermined level, float 20 is raised and rod 22 pivoted upwardly such that inlet valve 18 is closed. Conversely, when the water in the tank falls below a predetermined level, the weight of float 20 and rod 22 cause those elements to pivot downwardly in the tank such that inlet valve 18 is opened and water is provided from supply conduit 16 and through a hose 23 and a splash attenuating pipe 2 to fill the tank again to its predetermined level.

An outlet 24, FIG. 1, is formed in the bottom of tank 15. Outlet 24 communicates with the channel 14 of toilet bowl 11 through a passageway 26. Normally, outlet 24 is closed by a conventional valve 28, which may comprise a flap valve or other means known in the toilet art. In the closed condition, valve 28 engages a valve seat 30 that surrounds outlet 24. A lever arm 32 operably interconnects valve 28 with a handle 34 that is mounted outside of tank 15. Various other known means may be utilized for interconnecting handle 34 and valve 28, including chains, plastic connectors and combinations of these elements.

As is well known, main toilet bowl 11 is flushed by pivoting handle 34 downwardly. This causes arm 32 to raise valve 28 from seat 30. The water which is in the tank discharges through outlet 24 and flows through passageway 26 and channel 14. As a result, the water then enters bowl 11 and causes the water 36 in the bowl to be flushed into sewer line 12 through gooseneck trap 13.

The above described elements of toilet apparatus 10 are constructed of materials that are well known in the toilet art. For example, the bowl and stand may be constructed of porcelain. Various plastics and metals may be utilized for the elements contained within the tank and the flushing mechanism.

As further illustrated in FIGS. 1 and 2, the present invention comprises a urinal bowl 40 that is permanently mounted to the inside wall of main toilet bowl 11 at a position proximate the front of bowl 11. Bowl 40 is preferably composed of porcelain or other conventional toilet bowl materials. The open upper end of bowl 40 is positioned slightly below the upper lip of main bowl 11. Bowl 40 includes a circumferential channel 42 formed about its upper end. A plurality of holes 44 are formed in channel 42 to communicate with the interior of bowl 40. This structure permits the urinal bowl to be flushed in a manner described more fully below.

An outlet 49 of urinal bowl 40 is connected to a discharge conduit 46 through a gooseneck trap 48. Conduit 46 extends between the porcelain inner and outer walls 50 and 52 of bowl 11 and gradually descends beneath the main bowl 11. The discharge conduit includes a lower end 54 that is communicably engaged with sewer line 12 below gooseneck trap 13.

Means are provided between supply conduit 16 and a urinal bowl 40 for selectively introducing water under service line pressure exclusively into bowl 40 in order to flush the bowl. In particular, a primary urinal flush line 56 interconnects supply conduit 16 with urinal bowl 40 and a urinal flush valve 58 selectively permits and blocks the flow of water through line 56 to the urinal bowl. Primary flush line 56 includes three pipe segments 60, 62 and 64. Segment 60 communicably interconnects supply conduit 16 with valve 58 Segment 62 interconnects flush valve 58 with a gate valve 66, the function of which is explained more fully below. Pipe segment 64 interconnects gate valve 66 with channel segment 21 of urinal bowl 40.

Flush valve 58 includes, among other elements, a valve housing 70 that is carried by an integral float chamber 72. An actuator element 74 extends through the outer wall of tank 15 and into valve housing 70. Float chamber 72 is mounted in an appropriate manner to the inside wall of tank 15, for example, by an appropriate mounting bracket 76, FIG. 2 or other means.

Figure 3:
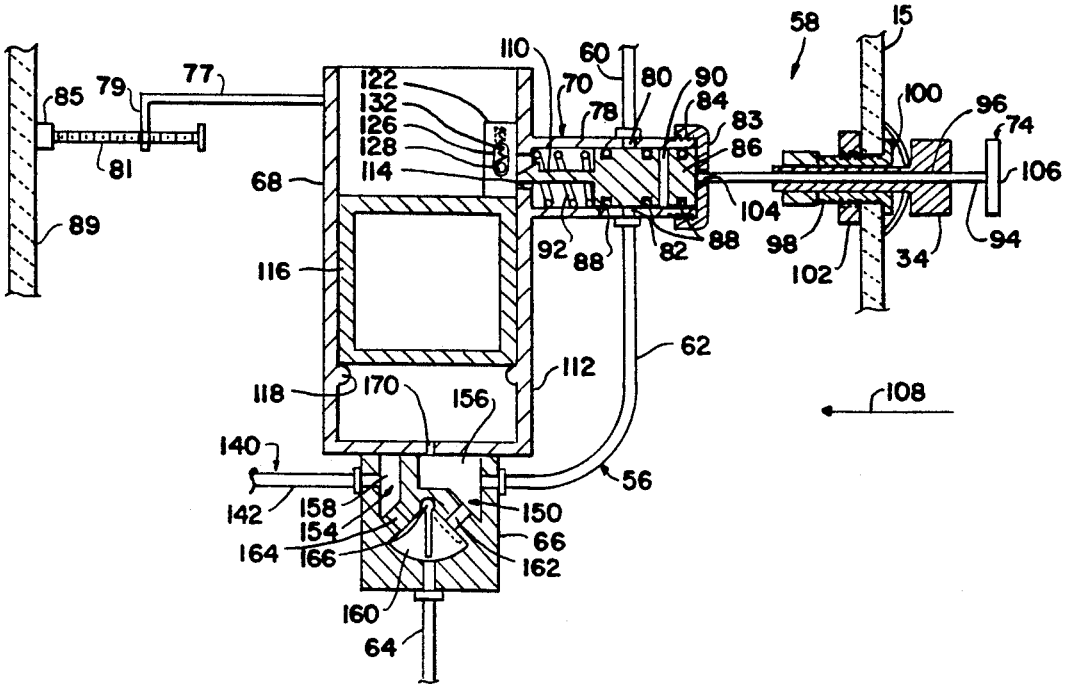
FIG. 3 is an elevational cross sectional view of the elements for selectively introducing water into the urinal bowl, with the urinal flush valve closed.

The particular structure of valve 58 is best shown in FIG. 3. Valve housing 70 includes an elongate wall 78 having an inlet 80 that is connected to pipe segment 60 of primary urinal flush line 56 and an outlet 82 that is connected to second pipe segment 62 of flush line 56. A cap 83 is secured to the distal end of wall 78 by appropriate means such as complementary threads 84. A piston-like valve element 86 is slidably disposed within valve housing 70. A plurality of O-rings 88 are formed about the periphery of the valve element to interengage the inside of valve housing wall 78. A transverse channel 90 is formed through the valve element. When the valve element is operated in the manner described more fully below, channel 90 is selectively and communicably aligned with first pipe segment 60 and second pipe segment 62 of flush line 56. Under normal circumstances, however, a compression spring 92 disposed within housing 70 biases valve element 86 toward the distal end of the valve housing such that channel 90 is not aligned with pipe segments 60 and 62 and the valve mechanism is closed.

Actuator element 74 comprises an elongate rod 94 that is longitudinally slidably mounted in the wall of reservoir tank 15. More particularly, rod 94 is mounted through a central recess 96 formed through main flush lever 34 of toilet 10. Flush lever 34 is itself pivotably mounted within a bushing 98 received through opening 100 in tank 15. The bushing is retained in the opening by a nut 102 or other suitable means. Rod 94 extends through the central opening 96 in lever 34 and through an opening 104 in cap 83 of valve housing 70. The inner end of rod 94 is secured integrally or in other appropriate ways to valve element 86. The opposite outer end of rod 94 carries a push button 106 that permits rod 94 to be selectively pushed through opening 96 in the direction of arrow 108. When the rod is pushed inwardly in this manner, it drives valve element 86 in a similar direction against compression spring 92 so that channel 90 may be aligned with outlets 80 and 82 and pipe segments 60 and 62 to open valve 58. Rod 94 preferably includes a non-circular cross sectional shape so that the rod, when pushed, avoids rotating within opening 96. In addition to mounting bracket 76 described above, a second stabilizing bracket 77 may be attached to and extended rearwardly from float chamber 68. Bracket 77 includes a depending portion 79 that is threadably engaged with a screw element 81. A resilient stop member 85 is carried at the distal end of element 81. Element 81 is threadably adjusted through bracket 77 so that element 85 engages the rearward wall 89 of tank 15. This further restricts float chamber 68 and the entire valve mechanism 58 from moving when actuator 74 is pushed.

Figure 4:
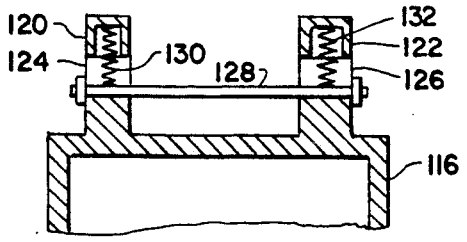
FIG. 4 is an elevational cross sectional view of the top of the float element and the second latch element.

The flush valve 58 is temporarily retained in an open condition by a latch mechanism. In particular, a first latch element 110 is carried by valve element 86 and extends through the center of compression spring 92. The adjoining wall 112 of float chamber 68 has an opening 114 that permits latch element 110 to pass longitudinally therethrough when the actuator 74 is pushed inwardly in the direction of arrow 108. Within float chamber 68 is disposed a float element 116 that is mounted on stops 118 formed on the inner wall of chamber 68. The side walls of float 116 preferably include ribs, not shown, that permit the float element to avoid binding on the side walls of chamber 68 and move freely up and down within the float chamber. As illustrated in FIGS. 3 and 4, a pair of mounting guides 120 and 122 extend upwardly from the top surface of float element 116. Guides 120 and 122 include respective openings 124 and 126 that accommodate a second elongate latch element 128. Compression springs 130 and 132 are disposed in respective recesses within the guides 120 and 122. Springs 130 and 132 bear downwardly against latch element 128 and provisionally hold it against the bottom surfaces of the guide recesses 124 and 126. This positioning is shown in both FIGS. 3 and 4.

Figure 5:
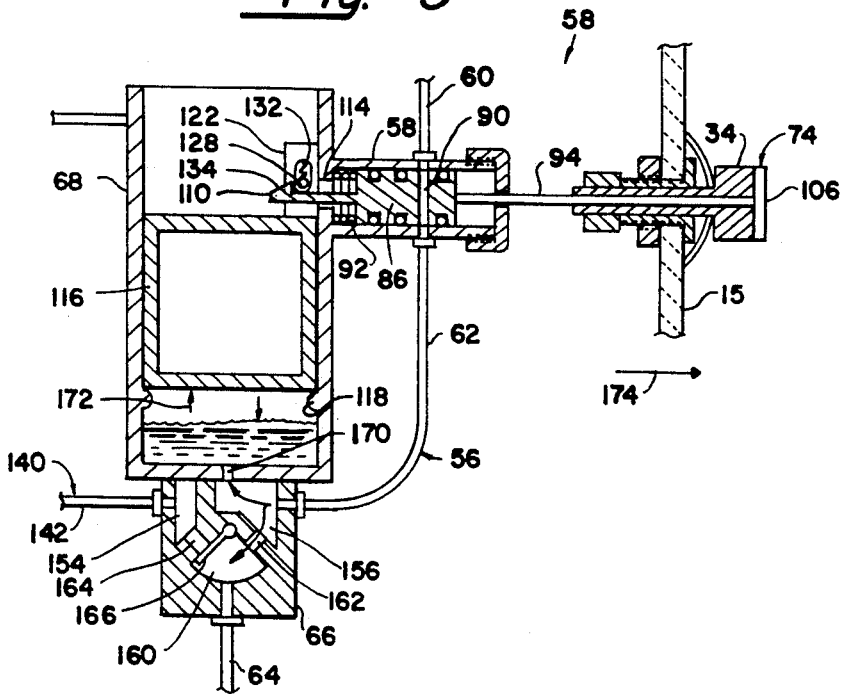
FIG. 5 is a view similar to FIG. 3, with the urinal flush valve open.

When actuator 74 is pushed in the direction of arrow 108, valve element 86 and first latch element 110 are pushed into the positions shown in FIG. 5. Channel 90 becomes aligned with pipe segments 60 and 62. Latch element 110 moves through opening 114 into float chamber 68. The sloped leading edge 134 of element 110 engages transverse latching element 128 and urges it upwardly against compression springs 130 and 132 until the head of latch element 110 passes beyond latch element 128. At that point, the springs 130 and 132 force element 128 downwardly so that the latch elements 110 and 128 are interengaged. As a result, valve element 86 is provisionally held in an open condition. Subsequent release of the latch element is accomplished in a manner described more fully below.

Toilet apparatus 10 further includes a secondary urinal flush line 140, FIGS. 1, 2, 3 and 5 that is interconnected between the inlet valve 18 and urinal bowl 40. Secondary line 140 directs water to the urinal bowl each time the inlet valve 18 is opened and the main toilet bowl 11 flushed. More particularly, line 140 includes a pipe segment 142 that is communicably interconnected between inlet valve 18 and gate valve 66. Line 140 further shares, with first urinal flush line 56, pipe segment 64, which extends between gate valve 66 and channel segment 21 of urinal bowl 40.

Gate valve 66, best shown in FIGS. 3 and 5, permits water under service line pressure to be directed to urinal bowl 40 through a selected one of urinal flush lines 56 and 140. The gate valve is carried by the bottom surface of float chamber 68 and is connected thereto, either integrally or by appropriate means such as bolts or screws. Pipe segment 62 of primary line 56 forms a primary inlet into gate valve 66. Similarly, pipe segment 142 of line 140 forms a secondary inlet into the gate valve. The gate valve includes various chambers and ducts that define a first passageway 150 and a second passageway 154. Passageway 150 interconnects pipe segments 62 and 64 and therefore defines a portion of the primary urinal flush line. Likewise, passageway 154 interconnects pipe segments 142 and 64 and thus defines a portion of the secondary urinal flush line. More particularly, gate valve 66 defines three chambers 156, 158 and 160. Chamber 156 is communicably interconnected to pipe segment 60, chamber 158 is likewise connected to pipe segment 142 and chamber 160 is interconnected to pipe segment 64. An orifice chamber 162 interconnects chambers 156 and 160 and a second orifice 164 similarly interconnects chambers 158 and 160. A gate element 166 is pivotably mounted to the body of the gate valve and extends into chamber 160.

Gate valve 66 operates in the following manner to selectively permit water under service line pressure to be introduced into urinal bowl 40 through either primary flush line 56 or secondary flush line 140. When flushing of only urinal bowl 40 is required, button 106, FIG. 3, is engaged and rod 94 is pushed inwardly in the direction of arrow 108. This causes channel 90 to be aligned with pipe segments 60 and 62 of line 56 in the manner shown in FIG. 5. As a result, water under service line pressure flows from supply conduit 16, FIG. 1, into pipe segment 60 and through channel 90, FIG. 5, into pipe segment 62. Water then enters chamber 156 of gate valve 66. The size of orifice 162 is selected such that water drains through that orifice into chamber 160 and at the same time, fills chamber 156. As water under service line pressure enters chamber 160 it pushes valve element 166 to the left such that the valve element blocks orifice 164 and closes passageway 154. As a result, secondary urinal flush line 140 is closed. As previously described, latch elements 110 and 128 are interengaged to hold valve element 86 in an open condition so that water continues to pass through pipe segment 64 to urinal bowl 40. This water enters channel segment 21 and channel 42 and is deposited through holes 44 into bowl 40. The weight of this water causes the water disposed in trap 42 to be discharged along with the liquid waste contained in the urinal bowl, through discharge conduit 46 and into sewer line 12. From there, the flushed liquid waste and water from the urinal bowl is discharged into a sewer or septic system in a conventional manner.

A duct 170, FIGS. 3 and 5, is formed in the bottom surface of float chamber 68 for interconnecting the interior of the float chamber with chamber 156 of gate valve 66. The diameter of pipe segment 62 is sufficiently large that, as the incoming water under service line pressure enters and fills chamber 156, eventually, water enters the interior of float chamber 68 through duct 170. This water gradually rises in the direction of arrow 172 and raises float element 116 so that latch element 128 is disengaged from latch element 110. As a result, spring 92 urges valve element 86 outwardly in the direction of arrow 174 so that channel 90 is misaligned with pipe segments 60 and 62. This causes the flush valve 58 to close so that the flow of water through first flush line 56 is stopped. Accordingly, the construction of the gate valve 66, float chamber 68 and float element 116 provide for automatic closing of the valve mechanism after a predetermined interval. This interval can be adjusted by varying the size and position of the float element and the sizes of the chambers, ducts and orifices within the gate valve and float chamber.

Figure 6:
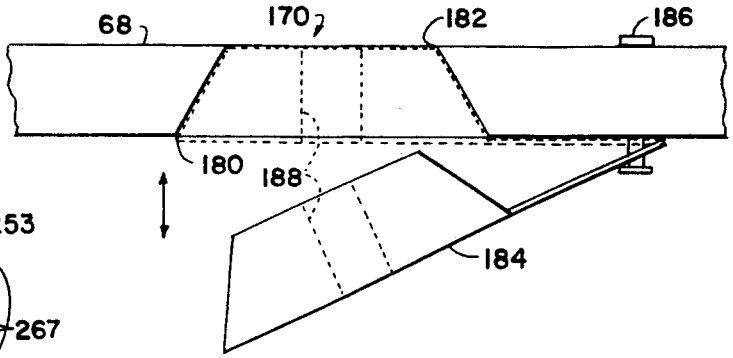
FIG. 6 is an elevational view of a preferred duct structure for introducing water into and draining water from the float chamber.

When the flow of water through flush line 56 is halted, the water in float chamber 68 and chambers 156 and 160 of gate valve 66 gradually drains through pipe segment 64. As a result, float element 116 resumes its previous position on stops 11B and the valve 5B is in a position that permits it to be subsequently actuated when necessary to flush only the urinal bowl 40. A preferred structure that permits rapid draining of chamber 68 is shown in FIG. 6. Therein, duct 170 in chamber 68 generally defines the shape of a truncated cone having relatively wide and narrow diameter portions 180 and 182 respectively. An elastomeric plug 184 is connected to the bottom surface of float chamber 68 by appropriate means such as a rivet 186. Various alternative means may be used to connect the plug to float chamber 68. Plug 184 likewise includes a shape generally in the form of a truncated cone that conformably mates with duct 170. A channel 188 is formed generally centrally through plug 184. The plug depends from the float chamber 68 at an angle of, for example, 20°.

In operation, when water is introduced into the chamber 156 though line 56, the incoming water under service line pressure forces plug 184 to shut within duct 170, as shown in phantom. Water is then introduced through central channel 188 into the float chamber. Subsequently, when flushing is completed and the latch is disengaged, the water pressure within float chamber 68 causes plug 84 to reopen so that water drains more rapidly out of the float chamber. Because plug 184 is suspended at a less than a 90° angle, it is readily closed by the incoming water. As a result, prompt draining is permitted.

Gate valve 66 also provides apparatus 10 with the ability to flush urinal bowl 40 in conjunction with the flushing of main toilet bowl 11. This is accomplished simply by pivoting handle 34 in a conventional manner. When inlet valve 18 opens, water is directed through pipe segment 142 and into passageway 158 of gate valve 66. As shown in FIG. 3, the incoming water, again under service line pressure, passes through orifice 164 and into chamber 160. As a result, as shown in FIG. 3, valve element 166 is pivoted to the right into the position shown in phantom so that orifice 162 and passageway 150 of first flush line 56 are closed. Water under service line pressure proceeds from pipe segment 142 into pipe segment 64 and then on to urinal bowl 40 where flushing is accomplished.

Figure 7A:
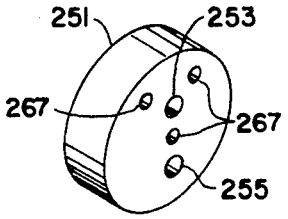
FIG. 7A is a perspective view of a mounting bracket used by this invention.
Figure 7:
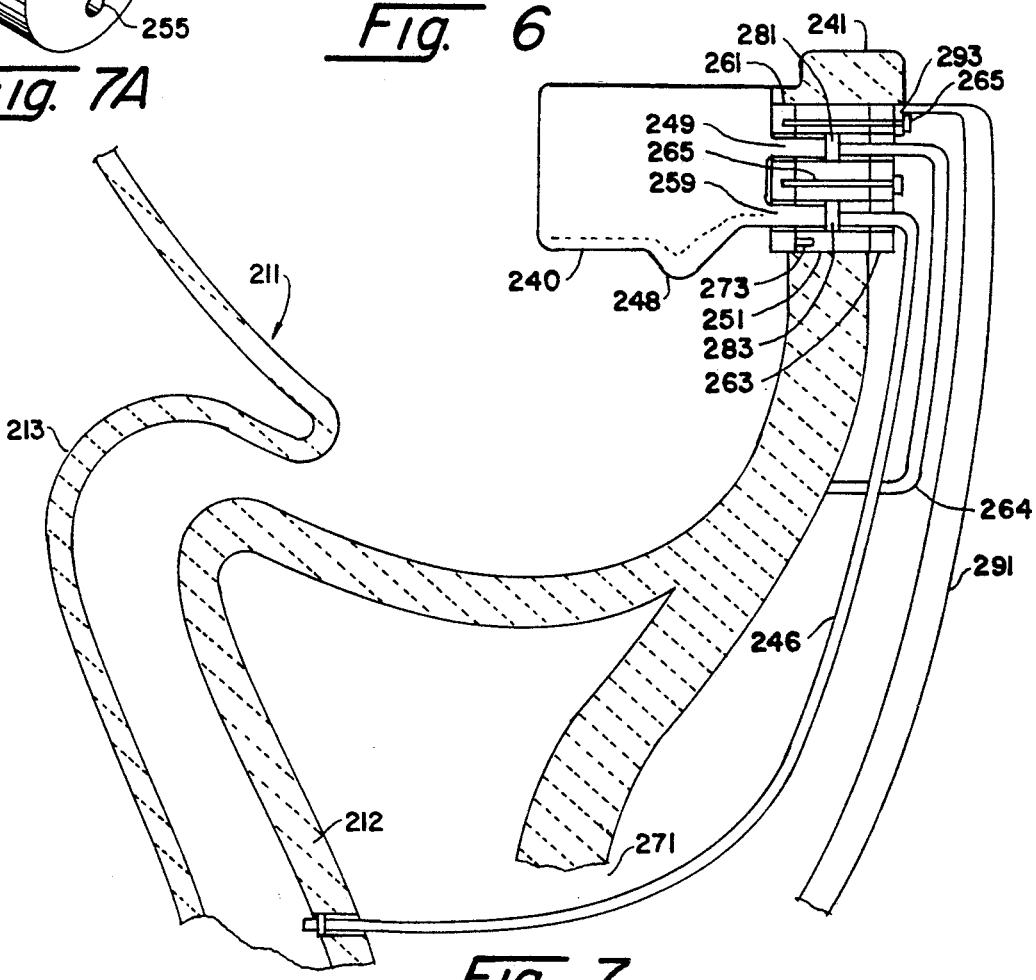
FIG. 7 is an elevational view, partly in cross section, of a toilet utilizing an alternative permanently mounted urinal bowl according to this invention.

An alternative preferred construction according to this invention is shown in FIG. 7. Therein, urinal bowl 240 is mounted through a bracket 251 formed in the side wall 241 of toilet bowl 211. More specifically, a mounting bracket 251, shown alone in FIG. 7A, is received by an opening in the side of bowl 211. Bracket 251 includes a pair of holes 253 and 255 that accommodate the urinal flush line and discharge conduit, respectively. A plate 261 is secured to the inner surface of bracket 251 and a second plate 263 is secured to the outer surface of the bracket. Plates 261 and 263 are secured by screws or bolts 265 that exit through holes 267, FIG. 7A, in bracket 251 and complementary aligned holes in plates 261 and 263. Each of the plates includes an opening that corresponds with opening 253 in bracket 251 and a second opening that corresponds with opening 255 in bracket 251. Urinal bowl 240 includes a tubular inlet stem 249 and a tubular discharge stem 259. Inlet stem 249 and discharge stem 259 extend through plate 261 and into opening 253 and the distal end of stem 249 is communicably connected to inlet pipe segment 264 by an appropriate fitting 281. Likewise, discharge stem 259 extends through plate 261 and into opening 255 and is communicably interconnected with discharge conduit 246 by an appropriate fitting 283. Plate 261 also includes a projection 273, which is received by a complementary recess in bracket 251. This helps to stabilize the urinal bowl in the side of the main toilet bowl. Both inlet pipe segment 264 and discharge conduit 246 extend through outer plate 263 and largely outside of the main toilet. As shown in phantom FIG. 2, segment 264 extends out through the front wall of reservoir tank 15 over the rear base of the toilet bowl and downwardly along the sides of the bowl to the position finally shown in FIG. 7. Discharge conduit 246 extends downwardly from mounting bracket 251 along the front of bowl 211. The discharge conduit then enters through the base of the bowl such as at point 271 and extends into the sewer line 212 below the gooseneck trap 213.

To cosmetically improve the appearance of this embodiment, a cover plate 291 is attached to mounting bracket 251. The cover plate 291 may include a lip 293 that engages the outer surface of plate 263 and has openings that align with the upper openings 267, FIG. 7A, of bracket 251 and the corresponding openings of plates 261 and 263. Bolts 267 received by the aligned openings hold cover 291 in place. The cover plate extends to a point proximate the floor so that the exterior pipes and conduits of this embodiment are generally hidden from view.

In the embodiment disclosed in FIG. 7, an internal trap 248 is formed in urinal bowl 240. Alternatively, in this embodiment, a trap may be eliminated entirely and a closure valve described below may be employed for preventing odors from entering the urinal bowl through the discharge conduit 246.

Figure 8:
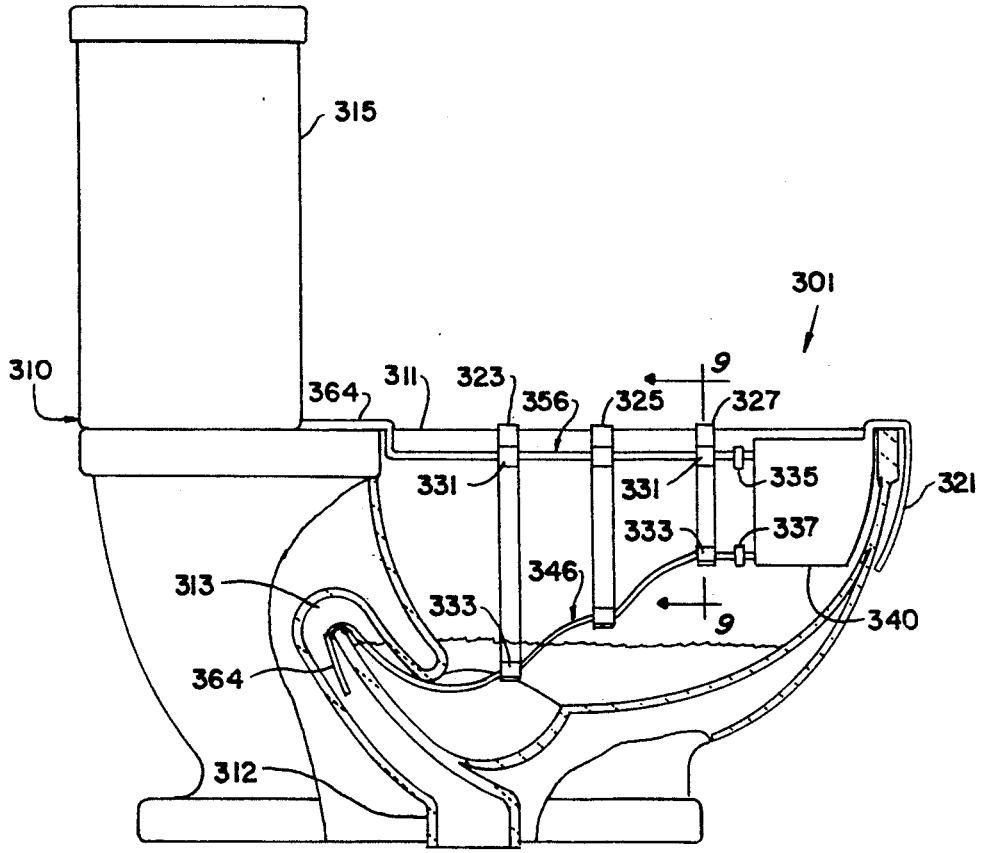
FIG. 8 is a side elevational view, partly in cross section, of a toilet utilizing another alternative urinal assembly according to this invention, which is removably attached or retrofit to an existing toilet bowl.

In the urinal assembly 301 disclosed in FIG. 8, the assembly is retrofit onto an existing toilet 310. Urinal bowl 340 is again mounted proximate the front of main toilet bowl 311. A bracket 321 extends from the upper edge of urinal bowl 340 and hooks over the forward lip of toilet bowl 311 to hold the urinal bowl in place.

Figure 9:
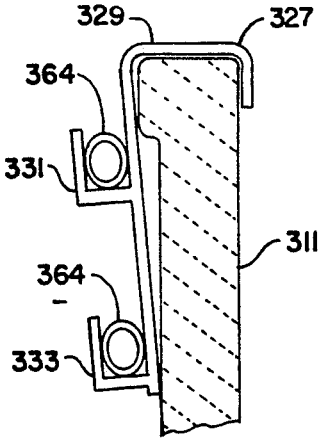
FIG. 9 is a cross sectional view taken along line 9—9 of FIG. 8.

A urinal flush line 356 and a discharge conduit 346 are employed for flushing the urinal bowl in the manner generally described above. Flush line 356 includes a pipe segment 364 that extends out of the forward wall of tank 315. A plurality of brackets 323, 325 and 327 are provided for carrying both the flush line 356 and discharge line 354 within the interior of toilet bowl 311. A representative one of the brackets 327 is depicted in FIG. 9. In particular, each bracket includes a hook portion 329 that extends over the upper lip of the bowl 311. A first rack element 331 carries the pipe segment 364 and a second lower rack element 333 carries the discharge conduit 364. At a point proximate urinal bowl 340, the rack elements 331 and 333 are relatively close together. However, those elements become more spaced apart as the distance from the urinal bowl increases. Therefore, the greatest spacing between elements 331 and 333 is exhibited by mounting Inlet stem 249 and discharge stem 259 extend through plate 261 and into opening 253 and the distal end of stem 249 is communicably connected to inlet pipe segment 264 by an appropriate fitting 281. Likewise, discharge stem 259 extends through plate 261 and into opening 255 and is communicably interconnected with discharge conduit 246 by an appropriate fitting 283. Plate 261 also includes a projection 273, which is received by a complementary recess in bracket 251. This helps to stabilize the urinal bowl in the side of the main toilet bowl. Both inlet pipe segment 264 and discharge conduit 246 extend through outer plate 263 and largely outside of the main toilet. As shown in phantom FIG. 2, segment 264 extends out through the front wall of reservoir tank 15 over the rear base of the toilet bowl and downwardly along the sides of the bowl to the position finally shown in FIG. 7. Discharge conduit 246 extends downwardly from mounting bracket 251 along the front of bowl 211. The discharge conduit then enters through the base of the bowl such as at point 271 and extends into the sewer line 212 below the gooseneck trap 213.

To cosmetically improve the appearance of this embodiment, a cover plate 291 is attached to mounting bracket 251. The cover plate 291 may include a lip 293 that engages the outer surface of plate 263 and has openings that align with the upper openings 267, FIG. 7A, of bracket 251 and the corresponding openings of plates 261 and 263. Bolts 267 received by the aligned openings hold cover 291 in place. The cover plate extends to a point proximate the floor so that the exterior pipes and conduits of this embodiment are generally hidden from view.

In the embodiment disclosed in FIG. 7, an internal trap 248 is formed in urinal bowl 240. Alternatively, in this embodiment, a trap may be eliminated entirely and a closure valve described below may be employed for preventing odors from entering the urinal bowl through the discharge conduit 246.

In the urinal assembly 301 disclosed in FIG. 8, the assembly is retrofit onto an existing toilet 310. Urinal bowl 340 is again mounted proximate the front of main toilet bowl 311. A bracket 321 extends from the upper edge of urinal bowl 340 and hooks over the forward lip of toilet bowl 311 to hold the urinal bowl in place.

A urinal flush line 356 and a discharge conduit 346 are employed for flushing the urinal bowl in the manner generally described above. Flush line 356 includes a pipe segment 364 that extends out of the forward wall of tank 315. A plurality of brackets 323, 325 and 327 are provided for carrying both the flush line 356 and discharge line 354 within the interior of toilet bowl 311. A representative one of the brackets 327 is depicted in FIG. 9. In particular, each bracket includes a hook portion 329 that extends over the upper lip of the bowl 311. A first rack element 331 carries the pipe segment 364 and a second lower rack element 333 carries the discharge conduit 364. At a point proximate urinal bowl 340, the rack elements 331 and 333 are relatively close together. However, those elements become more spaced apart as the distance from the urinal bowl increases. Therefore, the greatest spacing between elements 331 and 333 is exhibited by mounting bracket 323.

Pipe segment 364 exits the forward wall of reservoir tank 315 and extends into the interior of toilet bowl 11. The pipe segment is then carried by the rack elements 331 of brackets 323, 325 and 327, respectively. These rack elements are at approximately the same height within the bowl and direct pipe segment 364 generally horizontally toward the urinal bowl 340. The distal end of pipe segment 364 is communicably interengaged with urinal bowl 340 by an appropriate fitting 335. The urinal bowl is provided with an appropriate channel and flush holes that direct the water delivered through pipe segment 364 into bowl 340 for flushing the bowl Discharge conduit 364 includes an upper end that is interconnected with a discharge outlet of bowl 340 by a fitting 337. The discharge conduit engages the respective rack elements 333 of brackets 327, 325 and 323 and is directed by those brackets in a generally downward direction towards the outlet of bowl 311. Discharge conduit 364 is snaked through gooseneck trap 313 and the distal end of conduit 364 is disposed within sewer line 312. In alternative embodiments, the urinal flush line and discharge conduit may be connected to the front of urinal bowl 340.

Figure 10:
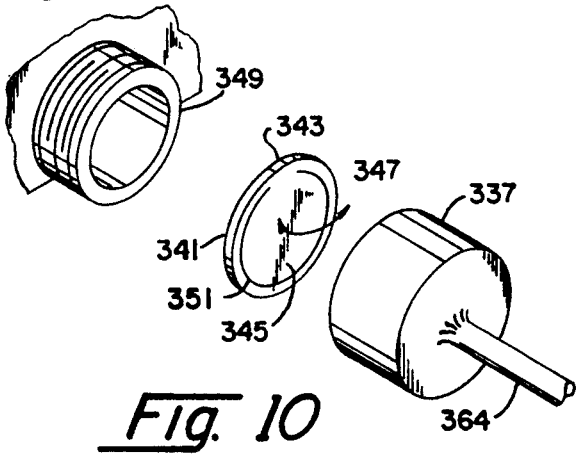
FIG. 10 is an exploded view of the outlet of the urinal bowl and the upper end of the discharge conduit with a flap valve therebetween, which flap valve replaces a trap for blocking the entry of odors from the discharge conduit into the urinal bowl.

A gooseneck trap is not employed for urinal bowl 340. Accordingly, to prevent obnoxious odors from entering the urinal bowl, a flap valve 341, FIG. 10 is utilized. Valve 341 comprises a generally elastomeric washer-like element 343 positioned between the outlet 349 of urinal bowl 340 and the fitting 337 at the upper end of discharge conduit 364. Element 343 has a flap 345 that pivots as indicated by double-headed arrow 347. Flap 345 includes a diameter that is larger than the opening 349 formed through element 343. Accordingly, when liquid waste is discharged from urinal bowl 340 through outlet 349, flap 345 opens to permit the liquid to be flushed from the urinal bowl. Subsequently, when flushing is complete the flap closes so that obnoxious odors are prevented from re-entering the urinal bowl from the discharge conduit.

Figure 11:
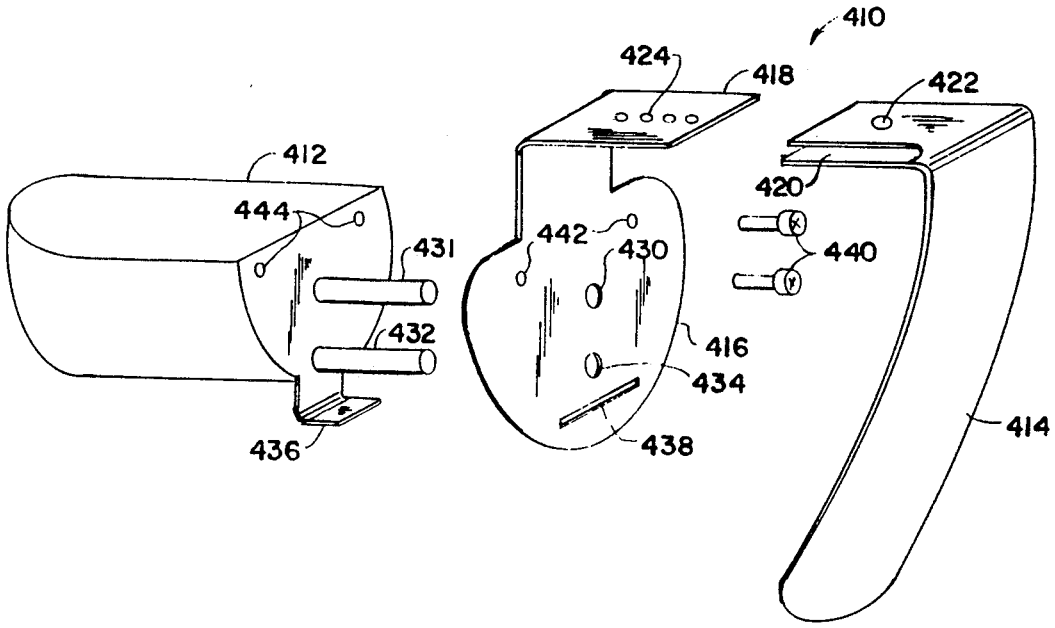
FIG. 11 is an exploded view of an alternative bracket assembly that may be used to retrofit the urinal bowl to an existing toilet.

FIG. 11 discloses an alternative bracket 410 for a retrofit urinal bowl 412. Bracket 410 includes an outer hook portion 414 and an inner clamp portion 416. Portion 416 has a flat segment 418 that is received by a slot 420 in hook portion 414. A set screw 422 permits segment 418 to be fixed at one of a plurality of positions defined by holes 424. This permits the bracket to engage various sizes of toilet bowls with the hook portion 414 draped over the outside of the bowl and the clamp portion hung inside the bowl.

Urinal bowl 412 includes an inlet stem 431 that is received by a hole 430 in clamp 416 and interconnected to an inlet pipe segment, not shown, in a manner previously described. Similarly, bowl 412 has a discharge stem 432 that extends through a hole 434 in clamp 416 and is interconnected to a discharge conduit as previously described. A stabilizing bar 436 carried by bowl 412 is received by a slot 438 in clamp 416 to help stabilize the urinal bowl on the clamp. Screws 440 are received by holes 442 in clamp 416 and complementary holes 444 in bowl 412 to mount the bowl to the clamp. Clips and other attachment means may also be used.

It should be noted that the details of the primary and secondary urinal flush line construction illustrated in FIGS. 1-5 may be employed in either of the embodiments of FIGS. 7, 8 and 11.

Accordingly, the present invention permits a urinal bowl to be flushed either exclusively of or in combination with the main toilet bowl. At the same time, this assembly employs water under service line pressure to directly flush the bowl. Water under gravity pressure in the reservoir tank is not required. Therefore, the owner may freely adjust the level of water in the reservoir tank to provide more or less flushing capability for the main toilet bowl. The urinal bowl is not dependent upon the water level in the reservoir tank.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A urinal assembly for use in a toilet apparatus having a toilet bowl, a tank communicably connected to and located generally above said bowl, a supply conduit for delivering water under service line pressure to said tank, inlet valve means attached to said supply conduit for regulating the flow of water into said tank, means for opening said inlet valve means when the water in said tank falls below a predetermined level to introduce water into said tank and for closing said inlet valve means when the water in said tank rises above said predetermined level to stop the flow of water into said tank, means for selectively releasing water in said tank into said toilet bowl to flush said bowl, and a sewer line connected to said toilet bowl for discharging the contents of said bowl when said bowl is flushed, said urinal assembly comprising:

a urinal bowl for mounting within said toilet bowl;

means, interconnected between said supply conduit and said urinal bowl, for selectively introducing water under service line pressure exclusively into said urinal bowl to flush said urinal bowl; said means for introducing including means defining a primary urinal flush line, which interconnects said supply conduit and said urinal bowl, and urinal flush valve means that are normally closed to restrict water from flowing through said primary urinal flush line into said urinal bowl and selectively opened to permit water under service line pressure to flow through said primary urinal flush line into said urinal bowl, said urinal flush valve means including a valve housing, a valve element movably mounted in said valve housing and having formed therethrough channel means that ar communicably alignable with said primary urinal flush line, spring means for biasing said valve element into a closed condition within said housing such that said channel is not aligned with said primary urinal flush line, and actuator means for selectively urging said valve element against said spring means to align said channel with said primary urinal flush line and open said urinal flush valve means, said means for introducing further including means for temporarily retaining said valve element in an open condition in said valve housing; and a discharge conduit interconnected between said urinal bowl and said sewer line for discharging the contents of said urinal bowl when said urinal bowl is flushed.

2. The assembly of claim 1 in which said means for introducing include means defining a primary urinal flush line, which interconnects said supply conduit and said urinal bowl, and urinal flush valve means that are normally closed to restrict water from flowing through said primary urinal flush line into said urinal bowl and selectively opened to permit water under service line pressure to flow through said primary urinal flush line into said urinal bowl.

3. The assembly of claim 2 in which said urinal flush valve means include a valve housing, a valve element movably mounted in said valve housing and having formed therethrough channel means that are communicably alignable with said primary urinal flush line, spring means for biasing said valve element into a closed condition within said housing such that said channel is not aligned with said primary urinal flush line, and actuator means for selectively urging said valve element against said spring means to align said channel with said primary urinal flush line and open said urinal flush valve means.

4. The system of claim 1 further including bracket means for releasably mounting said urinal bowl to said main toilet bowl.

5. The system of claim 1 in which said means for introducing include means for releasing said means for retaining to close said urinal flush valve means after a predetermined amount of water is introduced to said urinal bowl.

6. The system of claim 5 in which said means for retaining include a first latch element carried by said valve element and a complementary second latch element mounted within said tank for interengaging said first latch element to retain said urinal flush valve means in an open condition.

7. The system of claim 6 in which said means for releasing include a float chamber mounted in said tank, and having an opening for introducing said first latch element into said float chamber, a float element disposed in said float chamber for carrying said second latch element and duct means that communicate with said primary urinal flush line for introducing water from said line into said float chamber, whereby said float element is raised to disengage said second latch element from said first latch element.

8. The system of claim 7 in which said duct means include means defining an inlet and a larger outlet that permit water to be introduced into said float chamber at a first rate and subsequently drained at a faster second rate when said latch elements are disengaged and said urinal flush valve means are closed.

9. The system of claim 7 in which stop means are formed on an inside wall of said float chamber to support said float element at a predetermined level.

10. The system of claim 7 further including means defining a secondary urinal flush line interconnected between said inlet valve means and said urinal bowl and being responsive to opening of said inlet valve means for directing water under service pressure therethrough into said urinal bowl.

11. The system of claim 10 further including a gate valve connected to said primary and secondary urinal flushing lines for selectively permitting water flow through one of said urinal flush lines while restricting water flow through the other said urinal flush line.

12. The system of claim 11 in which said primary and secondary urinal flush lines include respective primary and secondary inlet segments that engage said gate valve and a common outlet segment interconnecting said gate valve and said urinal bowl, said gate valve including means defining primary and secondary passageways that communicably interconnect said outlet segment with said primary and secondary inlet segments respectively and a valve element that permits water under service line pressure to flow through a selected one of said passageways while restricting the flow of water through the other said passageway.

13. The system of claim 11 in which said gate valve is carried by said float chamber.

14. A urinal assembly for use in a toilet apparatus having a toilet bowl, a tank communicably connected to and located generally above said bowl, a supply conduit for delivering water under service line pressure to said tank, inlet valve means attached to said supply conduit for regulating the flow of water into said tank, means for opening said inlet valve means when the water in said tank falls below a predetermined level to introduce water into said tank and for closing said inlet valve means when the water in said tank rises above said predetermined level to stop the flow of water into said tank, means for selectively releasing water in said tank into said toilet bowl to flush said bowl, and a sewer line connected to said toilet bowl for discharging the contents of said bowl when said bowl is flushed, said urinal assembly comprising:

a urinal bowl for mounting within said toilet bowl;

means, interconnected between said supply conduit and said urinal bowl, for selectively introducing water under service line pressure exclusively into said urinal bowl to flush said urinal bowl, said means for introducing including means defining a primary urinal flush line, which interconnects said supply conduit and said urinal bowl, and urinal flush valve means that are normally closed to restrict water from flowing through said primary urinal flush line into said urinal bowl and selectively opened to permit water under service line pressure to flow through said primary urinal flush line into said urinal bowl, said urinal flush valve means including a valve housing, a valve element movably mounted in said valve housing and having formed therethrough channel means that are communicably alignable with said primary urinal flush line, spring means for biasing said valve element into a closed condition within said housing such that said channel is not aligned with said primary urinal flush line, and actuator means for selectively urging said valve element against said spring means to align said channel with said primary urinal flush line and open said urinal flush valve means, said means for introducing further including means for temporarily retaining said valve element in an open condition in said valve housing;

a discharge conduit interconnected between said urinal bowl and said sewer line for discharging the contents of said urinal bowl when said urinal bowl is flushed; and a secondary urinal flush line interconnected between said inlet valve means and said urinal bowl means and being responsive to opening of said inlet valve means for directing water under service line pressure into said urinal bowl.

15. The system of claim 14 further including a gate valve connected to said primary and secondary urinal flush lines for selectively permitting water flow through one of said urinal flush lines while restricting water flow through the other said urinal flush line.

* * * * *